United States Patent [19]

Phillips et al.

[11] 4,372,812

[45] Feb. 8, 1983

[54] CHLORINE FREE PROCESS FOR BLEACHING LIGNOCELLULOSIC PULP

[75] Inventors: Richard B. Phillips, Mobile, Ala.; Arthur W. Kempf, Warwick, N.Y.; Robert C. Eckert, Kent, Wash.

[73] Assignee: International Paper Company, New York, N.Y.

[21] Appl. No.: 233,668

[22] Filed: Feb. 11, 1981

Related U.S. Application Data

[63] Continuation of Ser. No. 57,170, Jun. 22, 1979, abandoned, which is a continuation of Ser. No. 894,606, Apr. 7, 1978, abandoned.

[51] Int. Cl.[3] ..... D21C 9/10; D21C 9/16

[52] U.S. Cl. ..... 162/40; 162/60; 162/65; 162/76; 162/78

[58] Field of Search ..... 8/111; 162/37, 40, 89, 162/19, 65, 78, 60, 76

[56] References Cited

U.S. PATENT DOCUMENTS

| | | | |
|---|---|---|---|
| 3,652,387 | 3/1972 | Wilder | 162/89 |
| 3,663,357 | 5/1972 | Liebergott | 162/78 |
| 3,806,404 | 4/1974 | Liebergott et al. | 162/65 |
| 3,980,517 | 9/1976 | MacTaggart | 162/238 |
| 4,080,249 | 3/1978 | Kempf et al. | 162/65 X |

FOREIGN PATENT DOCUMENTS

| | | | |
|---|---|---|---|
| 966604 | 11/1971 | Canada | 162/65 |
| 2040763 | 11/1971 | Fed. Rep. of Germany | 162/65 |

OTHER PUBLICATIONS

Suteland "Bleaching of Chemical Pulps With Oxygen and Ozone" *Pulp and Paper Magazine of Canada,* vol. 75, No. 4 Apr. 1974.

Liebergott "Sequential Treatment of Mechanical Pulps at High Consistency With $H_2O_2$ and $O_3$" *Pulp & Paper Canada*, pp. 70–73, vol. 73, No. 9, Sep. 1972.

*Primary Examiner*—Steve Alvo

*Attorney, Agent, or Firm*—James F. Haley, Jr.,; Robert M. Shaw

[57] ABSTRACT

A chlorine-free bleaching process for lignocellulosic pulp characterized by a series of bleaching stages comprising in sequence a peroxide bleaching stage, the peroxide being selected from the group consisting of alkaline hydrogen peroxide, acidic hydrogen peroxide, and peroxy acid and at least one ozone bleaching stage and in one embodiment the sequence including an initial oxygen bleaching stage before the peroxide bleaching stage. In continuous operation the effluent from each of these sequential stages provides the preferred wash for the preceding washing step and the diluent for the preceding bleaching stage, the final effluent being recyclable for effective closed cycle operation.

6 Claims, No Drawings

CHLORINE FREE PROCESS FOR BLEACHING LIGNOCELLULOSIC PULP

This is a continuation of application Ser. No. 051,170, filed June 22, 1979 now abandoned, which is continuation of application Ser. No. 894,606, filed Apr. 7, 1978, now abandoned.

BACKGROUND OF THE INVENTION

This invention relates to the bleaching of lignocellulosic pulp. More particularly, the invention is directed at a novel chlorine-free bleaching process for such pulp. This novel process affords a sequence of bleaching stages wherein the reaction conditions of each stage are of such pH and temperature that substantially no pH or temperature adjustment is needed prior to the next following bleaching stage of the sequence. Moreover, the effluent derived from the bleaching stage itself or that washing which preferably follows each stage is suitable for use as counter-current wash water in the next earlier sequential bleaching stage in continuous bleaching processes.

Wood is composed of two main parts—a fibrous carbohydrate or cellulosic portion and a non-fibrous portion comprising a complex chemical, commonly referred to as lignin.

For use in paper-making processes wood must first be reduced to pulp, which can be defined as wood fibers capable of being slurried or suspended and then deposited as a screen to form a sheet. The methods employed to accomplish this pulping usually involve either physical or chemical treatment of the wood, or perhaps some combination of the two processes, to alter its chemical form and to give desired paper properties.

In mechanical pulping, the wood is physically ground to a high-yield pulp, most often referred to as groundwood pulp. In chemical pulping, the wood chips are digested with chemical solutions to solubilize a portion of the lignin and effect is removal. The more usual of these digestive procedures are the sulfite, sulfate or Kraft, soda and modified sulfite processes.

After the wood has been digested, the resulting material is generally a darkly colored cellulose fiber. The dark color is attributable to the fact that not all of the lignin has been removed during digestion and the remaining lignin has been chemically modified. This dark pulp is commonly referred to as unbleached pulp. It may pass directly to the paper making operation if the paper color is unimportant.

More usually, the unbleached lignocellulosic pulps are bleached to a brightness consistent with the planned utilization of the pulp, such brightness being a measure of the reflectivity of the pulp under standardized conditions. Pulp bleaching is most often a multi-stage process employing chlorine or chlorine-containing compounds such as calcium hypochlorite, sodium hypochlorite and chlorine dioxide. Exemplifying the chlorine bleaching of lignocellulosic pulps are the processes disclosed in U.S. Pat. Nos. 1,957,937; 2,975,169, 3,462,344; C. Mlakar & J. Peltonen, "Peroxide in the Semibleaching of Kraft Pulp", *Paperi ja Puu,* 629–638 (1968); M. Delattre, "Hydrogen Peroxide as a Bleaching Agent for Kraft Pulps", *Paperi ja Puu,* 117–127 (1971); and P. Christensen, "Bleaching Sulphate Pulp with Hydrogen Peroxide", *Pulp and Paper Magazine of Canada,* 62–66 (1971).

Although such chlorine and chlorine containing compounds have proven to be effective bleaching agents, the chlorine compounds are difficult to handle and hazardous to both personnel and machinery. The effluents from chlorine bleaching process contain large amounts of chlorides as the major by-product of the bleaching process. The chloride salts readily corrode paper-making equipment. Moreover, chloride salt concentration build-up precludes recycling in closed system operation without employing recovery operations using expensive metallurgy. Further, discard of the effluents from chlorine-based bleaching processes poses serious pollution problems.

To avoid these disadvantages, the paper industry has worked to reduce or totally eliminate chlorine containing compounds from multi-stage bleaching processes for lignocellulosic pulps. Complicating these efforts is the requirement that high levels of pulp brightness, 80% and above, are required for many of the uses for such pulps.

One method wherein the amount of chlorine containing compounds necessary to afford a high degree of pulp brightness is reduced is described by P. Christensen, "Bleaching of Sulphate Pulps with Hydrogen Peroxide", *Norsk Skogindustri,* 268–271 (1973). There, oxygen is employed as a first stage bleaching agent to solubilize a major amount of lignin for removal. The remaining lignin is best removed to afford a fully-bleached pulp by more classical chlorine bleaching methods but using much reduced amounts of chlorine bleachant. However, even at such reduced chlorine concentrations, the corrosive and polluting chloride salts would soon reach unacceptable levels of concentrations in closed cycle operations.

One pulp bleaching method which eliminates chlorine containing bleaching agents is disclosed by N. Liebergott, "Paprizone Treatment, A New Technique for Brightening and Strengthening Mechanical Pulps". This bleaching process, in effect a single stage, combines peroxide and ozone in a synergistic combination to brigthen and strengthen mechanical pulps. It should be noted that this process is not suited to chemical pulps, nor is it capable of achieving high pulp brightness (80%) with either mechanical or chemical pulps.

Canadian Pat. No. 966,604 discloses a multi-stage bleaching process which also wholly eliminates the disadvantageous chlorine compounds. This process is characterized by from one to three ozone bleaching stages and a final treatment with alkaline hydrogen peroxide, each stage being separated by an alkaline extraction. One such sequence may be described in the common shorthand nomenclature of the paper industry as ZEZE $P_{alk}$ wherein "Z" represents ozone bleaching; "E"—alkaline extraction; and "$P_{alk}$"—alkaline hydrogen peroxide bleaching. In accordance with this process, the effluent from each treatment stage may be collected and recycled for use in subsequent bleaching operations, preferably at an earlier stage than that from which it was obtained. This provides a so-called countercurrent effluent flow.

Other non-chlorine bleach sequences are described by S. Rothenberg, D. Robinson & D. Johnsonbaugh, "Bleaching of Oxygen Pulps with Ozone", *Tappi,* 182–185 (1975)—Z, ZEZ, $ZP_{alk}$ and $ZP_a$ ($P_a$—peroxyacetic acid); and N. Soteland, "Bleaching of Chemical Pulps With Oxygen and Ozone", *Pulp and Paper Magazine of Canada:* T153–58 (1974)—$OZEP_{alk}$ (O—Oxygen), $OP_{alk}$ and $ZP_{alk}$.

However, in all prior multi-stage non-chlorine lignocellulosic pulp bleach sequences large reaction condition disparities exist between sequential adjacent stages. For example, in Canadian Pat. No. 966,604 the ozone bleaching stages are conducted at 25° C. (77° F.) while the following intermediate alkaline extractions are effected at about 65°–71° C. (150°–160° F.) and the final alkaline peroxide stage at about 44° C. (112° F.). Therefore, both heating and cooling stages must be included in any operative sequence. Moreover, the alkaline extractions are carried out in 1–2% sodium hydroxide solutions but the final alkaline peroxide stage is effected in only 0.48% sodium hydroxide. Hence, a significant pH adjustment is required. Similarly, in Rothenberg et al., "Bleaching of Oxygen Pulps with Ozone", the ozone bleaching is effected at room temperature (about 25° C.) but the extraction or peroxide stages are carried out at 70° C. and in "Bleaching of Chemical Pulps with Oxygen and Ozone", the oxygen stage is conducted at 110° C. and the other stages at 50°–60° C.

Such marked variations in both temperature and pH between adjacent stages in a multi-stage bleaching process greatly disadvantage these systems. Instead significant efforts must be expended to cool or heat and acidify or basify the pulp slurry as it sequentially moves through the bleaching process. This is uneconomical from a material, equipment, and energy standpoint.

SUMMARY OF THE INVENTION

Accordingly, it is an object of this invention to provide a non-chlorine multi-stage process for bleaching lignocellulosic pulp which minimizes the changes in temperature and pH from stage to stage.

Another object of this invention is to provide a non-chlorine bleaching process which produces fully bleached lignocellulosic chemical pulps of pulp brightness above 80% on the G.E. scale, such pulp displaying improved brightness stability as compared to conventional chlorine bleached pulp.

A still further object of this invention is to provide a non-chlorine process for bleaching pulp which results in a fully bleached lignocellulosic pulp displaying high pulp strength and being productive of papers having superior paper properties.

Another object of this invention is to provide a continuous multi-stage bleaching process wherein each chlorine-free stage is preferably followed by a pulp washing, the wash water of each washing being selected from the group consisting of the effluent from the next later pulp treatment stage, the effluent from the washing of the pulp following the next later stage, make-up water, effluent from the recovery process and any combination of same in counter-current flow fashion.

Another object of this invention is to provide a continuous multi-stage bleaching process wherein the effluents from each stage, washing, or final counter-current flow may be recycled to the recovery furnace without danger of corrosion or explosion.

These and other additional objects and advantages of this invention, apparent from the detailed description and claims which follow are accomplished in one embodiment of this invention by a multi-stage chlorine-free bleaching process comprising in sequence: an oxygen bleaching stage; a peroxide bleaching stage, the peroxide being selected from the group consisting of alkaline peroxides, acidic peroxides and peracids; and at least one ozone bleaching stage. In processes of only one ozone stage (e.g. OPZ) no extraction stage is normally required following the ozone stage, but in multi-ozone stage bleaching each ozone bleaching stage is preferably separated by a caustic extraction stage.

These advantages are also realized in another but less preferred embodiment of this invention wherein the multi-stage chlorine-free bleaching process comprises in sequence a peroxide bleaching stage, the peroxide being selected from the group consisting of alkaline hydrogen peroxides, acidic hydrogen peroxides and peracids; and at least one ozone bleaching stage, each ozone bleaching stage preferably being separated by a caustic extraction stage.

DETAILED DESCRIPTION OF THE INVENTION

This invention relates to a novel multi-stage chlorine-free process for bleaching lignocellulosic pulp. According to this invention wood pulps and other lignocellulosic pulps may be utilized to good advantage. By way of example, preferred lignocellulosic pulps include those wood pulps digested by the well-known sulfite, sulfate or Kraft, soda and modified sulfite processes. The process is particularly useful for the bleaching of Kraft pulps.

The actual pulping of wood chips or other fiber containing substances forms no part of this invention. Rather, the bleaching process described herein is employed to good advantage on lignocellulosic pulps obtained by a wide variety of prior art processes.

In a first embodiment, the novel bleaching process of this invention comprises in sequence: (a) an oxygen bleaching stage; (b) a peroxide bleaching stage, the peroxide being selected from the group consisting of alkaline hydrogen peroxides, acidic hydrogen peroxides and peracids; and (c) at least one ozone bleaching stage.

In another embodiment of this invention, the bleaching process comprises in sequence: (a) a peroxide bleaching stage, the peroxide being selected from the group consisting of alkaline hydrogen peroxides, acidic hydrogen peroxides and peracids; and (b) at least one ozone bleaching stage. Thus, this second, but less preferred, embodiment eliminates that oxygen bleaching stage included in the earlier described and more preferred embodiment.

Preferably, only intermediate ozone bleaching stages are followed by an extraction stage. The final ozone bleaching stage is not usually followed by such alkaline extraction. More preferably, each stage, i.e. oxygen, peroxide, ozone, and caustic extraction, if any, in the sequence of this invention is followed by a washing of the lignocellulosic pulp. Such washing may be effected as a wholly separate operation or in the more usual case on a portion of the rotating screen or filter drum surface used to separate the earlier treatment solution from the bleached pulp in preparation for the next treatment of the process.

The bleaching stages, extraction stages and pulp washing processes of this invention are conventional. Their reactive conditions, procedures, process limitations and designs are well-known in the art. They form no part of this invention. Rather, it is the sequence of the specific bleaching stages that affords the advantages noted by applicants in their invention.

Most commonly, oxygen bleaching stages are carried out in about 3 to 30% pulp consistency at 0.2 to about 3% oxygen, based on O.D. (oven-dried) pulp. The bleaching is effected at 80°–120° C. and pH 9–12 for 10–60 minutes. Such conditions are similar to that oxygen bleaching described by Soteland, "Bleaching of Chemical Pulps With Oxygen and Ozone", *Pulp and Paper Magazine of Canada,* 75, T153–58 (1974).

The peroxide bleaching stage of this invention is internal or upstream of the ozone stage. It may be carried out by any of the well-known alkaline peroxide, acid peroxide or peracid bleaching processes. Alkaline peroxide bleaching stages are usually carried out on pulp of 10–25% consistency in the presence of 0.2 to about 2% peroxide, based on O.D. pulp. The bleaching is performed at 20°–90° C. and pH 7–11 for a reaction time of about 10 to 300 minutes. Conventional peroxide stabilizers are commonly used. Similar conditions are disclosed by Vartiainen, "Utilization of Peroxide in Pulp Bleaching", *Paperi ja Puu,* 51, 277–284 (1969) and N. Hartler et al., "Peroxide Bleaching of Kraft Pulps", *Tappi,* 43, 806–813 (1960). Under peracid conditions, the peroxide bleaching step is conducted on pulp of 3–25% consistency with 0.2–2% peracid, expressed as $H_2O_2$ on O.D. pulp basis. The bleaching is performed at 20°–90° C. and pH 3–10 for a reaction time of 10–300 minutes. Acidic peroxide bleaching is usually effected at pulp consistencies of 10–25% and 0.2–2% peroxide based on O.D. pulp at 40°–80° C. and pH 3–5. More preferably, 5–100%, based on the peroxide weight, of metal activators selected from the group comprising tungsten, titanium, tin, molybdenum, chromium, osmium, selenium, and vanadium are added to such acid peroxide bleaching stages.

Ozone bleaching stages are carried out for example as described in Rothenberg et al., "Bleaching of Oxygen Pulps With Ozone", *Tappi,* 58, 182–185 (1975), Canadian Pat. No. 966,604 and U.S. patent application Ser. No. 705,869, filed July 16, 1976, U.S. Pat. No. 4,080,869 and having a common assignee. Such processes are conducted at 1–40% pulp consistency and 0.2 to 1% ozone (consumed) on an O.D. pulp basis. The reaction is usually carried out at 15°–60° C. and pH 2–7 for about 5–30 minutes.

The caustic extraction stages which preferably follow the conventional ozone stages are likewise described in the prior art. They include those of Canadian Pat. No. 966,604, e.g. with about a 2% sodium hydroxide solution at 65°–71° C. (150°–160° F.) for about 1.5 hours. Most preferably, the alkaline extraction is effected at pH about 6–8 and at a temperature of 20°–60° C. for about 10 minutes on pulp of 1–15% consistency.

As noted above each bleaching stage and extraction stage of this process is most preferably followed by a washing of the pulp. Such conventional washing at about 1.0% pulp consistency affords final removal of the bleaching or extraction solutions and solubilized compounds therein from the pulp prior to further bleaching. While fresh or recycled and recovered wash water may be employed for such washing stages, it is more preferred to use the effluents from the next later stage of the bleaching sequence as shower water for that washing following the preceding stage of the continuous bleaching process. Moreover, such effluents may be used to dilute the filtered and washed pulp slurry to the appropriate consistency for the next sequential treatment stage. This counter-current washing and dilution markedly reduces the amount of fresh water needed in the multi-stage bleaching process. The effluents from the bleaching, washing and extraction steps and counter-current flow are amenable to recycling through a conventional recovery furnace to remove contaminants and permit reuse in the substantially closed cycle bleaching process. One advantage of this sequential process is that such recycling may be had without fear of corrosion due to sodium chloride effluent bluid-up or explosion due to chloride in the smelt. It should be understood that while a continuous bleaching process is described above, a batchwise sequence would also enable such counter-current flow.

In order to describe the present invention so that it may be more clearly understood, the following examples are set forth. These examples are primarily for the purpose of illustration and any specific enumeration therein should not be construed as a limitation on the concept of this invention.

In the following examples a northern hardwood was pulped via a conventional Kraft process. The pulp was oxygen bleached and washed under standard conditions (pH 12, 100° C.) to a 6.3 permanganate number, giving a viscosity of 22.4 cp (½% C.E.D.) and brightness of 46.5% G.E. This semi-bleached pulp was further contacted with an appropriate series of bleaching stages, alkaline extraction steps and wash steps in accordance with the preferred embodiments of this invention. The reaction conditions of the bleaching and extraction steps of these stages are shown in Table I.

TABLE I

| Step | % Chemical Based on O.D. Pulp | pH | Temperature (°C.) | Pulp Consistency (%) | Time (minutes) |
|---|---|---|---|---|---|
| 1st Ozone (Z) | 0.80 | 3.0 | 22 | 1.0 | 20 |
| Extraction (E) | — | 7.5 | 50 | 6.0 | 10 |
| 2nd Ozone (Z) | 0.40 | 3.0 | 22 | 1.0 | 20 |
| Alkaline Hydrogen Peroxide ($P_{alk}$) | 1.00 | 10.5 | 77 | 10.0 | 120 |
| Peracid ($P_a$) (peracedic acid) | 2.23* | 7.5 | 77 | 10.0 | 180 |

*Molar equivalent to 1.0% $H_2O_2$

Maintaining these reaction conditions constant, a number of examples varying the bleaching sequence were performed. Examples I and III are multi-stage bleaching operations in accordance with the sequence of this invention and Examples II and IV are bleaching sequences as described in the prior art. The results of this comparison is displayed in Table II.

TABLE II

| | | Fully Bleached Results | | | |
|---|---|---|---|---|---|
| Exs. | Sequence | Viscosity (cp) | Brightness (G.E. %) | Yield (%) | Reverted Brightness* (%) |
| I | $OP_{alk}ZEZ$ | 12.7 | 83.9 | 96.4 | 80.3 |
| II | $OZEZP_{alk}$ | 12.4 | 85.9 | 95.2 | 76.9 |
| III | $OP_aZEZ$ | 11.7 | 88.6 | 96.0 | 84.0 |
| IV | $OZEZP_a$ | 9.6 | 89.1 | 96.1 | 87.3 |

*Brightness after heating at 105° C. for two hours.

Therefore, the novel bleaching sequence of this invention is about as effective in bleaching Kraft pulp as prior nonchlorine processes. More importantly, the paper made from pulp bleached in accordance with this invention displays improved characteristics as compared with prior art bleaching processes. These are exhibited in Table III.

TABLE III

| Example Sequence | I $OP_{alk}ZEZ$ | II $OZEZP_{alk}$ | III $OP_aZEZ$ | IV $OZEZP_a$ |
|---|---|---|---|---|
| Physical Properties at 400 CSF | | | | |

TABLE III-continued

| Example Sequence | I $OP_{alk}ZEZ$ | II $OZEZP_{alk}$ | III $OP_aZEZ$ | IV $OZEZP_a$ |
|---|---|---|---|---|
| Initial Freeness, ml | 620 | 625 | 630 | 625 |
| PFI revs. to 400 CSF | 3208 | 2153 | 2750 | 2239 |
| Basis Weight, lb/25 × 40–500 | 43.0 | 43.1 | 43.1 | 43.0 |
| Caliper, 0.001 in. | 3.29 | 3.25 | 3.29 | 3.34 |
| Density, g/cc | 0.726 | 0.736 | 0.726 | 0.713 |
| Tensile, lb/in. | 29.4 | 27.0 | 28.5 | 27.4 |
| Breaking Length, km | 8.670 | 7.942 | 8.381 | 8.082 |
| ZSBL, km | 12.720 | 12.197 | 12.934 | 12.581 |
| Mullen, psi | 52.3 | 49.2 | 52.6 | 51.9 |
| Burst Factor | 60.8 | 57.1 | 60.9 | 60.4 |
| Tear, gm | 47.3 | 43.5 | 46.2 | 42.3 |
| Tear Factor | 78.3 | 71.8 | 76.2 | 69.9 |
| Opacity, % | 71.4 | 71.3 | 71.0 | 71.0 |
| Scatter, Coef., $cm^2/g$ | 265.2 | 265.3 | 260.7 | 276.4 |
| Stretch, % | 3.56 | 2.94 | 3.39 | 3.10 |
| Tensile Energy Absorption, in.-lb/in.$^2$ | 0.727 | 0.552 | 0.673 | 0.582 |
| Modulus $\times 10^{-10}$, dynes/$cm^2$ | 4.87 | 5.04 | 4.91 | 4.62 |

However, the major benefit of this invention is that the temperature and pH adjustments required during the bleaching sequence are minimized as compared to the prior art sequences. This sequential comparison is depicted in Table IV.

TABLE IV

| A. Example I ($OP_{alk}ZEZ$) vs. Example II ($OZEZP_{alk}$) | | |
|---|---|---|
| | Temperature (°C.) | pH |
| I | 100, 77, 22, 50, 22 | 12.0, 10.5, 3.0, 7.5, 3.0 |
| II | 100, 22, 50, 22, 77 | 12.0, 3.0, 7.5, 3.0, 10.5 |
| **B. Example III ($OP_aZEZ$) vs. Example IV ($OZEZP_a$)** | | |
| | Temperature (°C.) | pH |
| III | 100, 77, 22, 50, 22 | 12.0, 7.5, 3.0, 7.5, 3.0 |
| IV | 100, 22, 50, 22, 77 | 12.0, 3.0, 7.5, 3.0, 7.5 |

Thus, Examples I and III, performed in accordance with this invention, avoid, for example, the wasteful cooling of the prior art between the oxygen stage (100° C.) and the second bleaching stage (22° C.) and the later heating from 22° C. to 77° C. of the prior art. Instead, the sequence of the invention admits much smaller adjustments from 100° C. to 77° C. and from 22° C. to 50° C. for the same stages. Significantly, these minor temperature changes may be effected by use of the effluent from later stages as a washing shower in counter-current fashion. For example, the use of effluent from the 77° C. step ($P_{alk}$) which is itself effluent from the 22° C. (Z) aids in cooling in 100° C. of the oxygen step to the next required 77° C. Like cooling is not available even with counter-current flow in the bleaching processes of the prior art. There, effluent from the 22° C. (Z) stage which is itself effluent from the 50° C. (E) stage cannot cool the 100° C. (O) stage pulp for the next required 22° C. (Z) stage. Analogous improvements inhere between those stages where the temperature must increase.

Similar benefits are apparent from a comparison of the pH adjustments required in the bleaching processes. For example, the pH need only drop from 12.0 to 10.5 between the first two stages of this invention as compared to 12.0 to 3.0 in prior art sequences. It is worthy of further note that the very minor pH adjustments of this process as compared with those of the prior art are producible with minor resort to external acidic and basic sources. For example, while the alkaline hydrogen peroxide bleaching step has an initial pH requirement of about 10.5, the bleaching itself reduces the pH by 1–1.5 units so in fact the Table IV depicted change of 10.5 to 3.0 in the sequence of this invention is less in actual practice, i.e. 9–9.5 to 3.0. A greater pH drop inheres in the peracid bleaching stage where from 3–4 units is observed.

While we have hereinbefore presented a number of embodiments of our invention, it is apparent that our basic construction can be altered to provide other embodiments which utilize our invention. Thus, it will be appreciated that the scope of our invention is to be defined by the claims appended hereto rather than the specific embodiments which have been presented hereinbefore by way of example.

We claim:

1. A non-chlorine multi-stage process for bleaching chemical lignocellulosic pulp which minimizes changes in temperature and pH from stage to stage, said process comprising in sequence:

(a) an oxygen bleaching stage carried out at about 3% to 30% pulp consistency, at 80° to 120° C. and at a pH of 9 to 12 for a reaction time of 10 to 60 minutes with an oxygen treatment solution comprising 0.2% to about 3% oxygen, based on oven-dried pulp, followed in sequence by separating the oxygen treatment solution from and washing the pulp at about 1% pulp consistency to afford final removal of the oxygen treatment solution from the pulp; then (b) a peroxide bleaching stage carried out at 10% to 25% pulp consistency, at 20° to 90° C. and at a pH of 3 to 5 for a reaction time of 10 to 300 minutes, with a peroxide treatment solution comprising 0.2% to about 2% peroxide, based on oven-dried pulp, followed in sequence by separating the peroxide treatment solution from and washing the pulp at about 1% pulp consistency to afford final removal of the peroxide treatment solution from the pulp, said peroxide being selected from the group consisting of alkaline hydrogen peroxide, acid hydrogen peroxide, and peracid; and then (c) at least one ozone bleaching stage carried out at 1% to 40% pulp consistency, at 15° to 60° C. and at a pH of 2 to 7, with an ozone treatment solution until 0.2% to 1% ozone on an oven-dried pulp basis is consumed, each said ozone bleaching stage being followed by separating the ozone treatment solution from and washing the pulp at about 1% pulp consistency to afford final removal of the ozone treatment solution from the pulp.

2. The process of claim 1 wherein each intermediate of said ozone stages is followed, subsequent to said washing, by a caustic extraction stage carried out with a caustic extraction solution followed in sequence by separating the caustic extraction solution from and washing the pulp at about 1% pulp consistency to afford final removal of the caustic extraction solution.

3. The process of claim 2 wherein the wash for said washing of the pulp following each of said stages is selected from the group consisting of the effluent from the next later stage, the effluent from the washing of said pulp following said next later stage, make-up water, effluent from a recovery process and any combination of same.

4. A non-chlorine multi-stage process for bleaching chemical lignocellulosic pulp which minimizes changes in temperature and pH from stage to stage, said process comprising in sequence:

(a) an oxygen bleaching stage carried out at about 3% to 30% pulp consistency, at 80° to 120° C. and at a pH of 9 to 12 for a reaction time of 10 to 60 minutes with an oxygen treatment solution comprising 0.2% to about 3% oxygen, based on oven-dried pulp, followed in sequence by separating the oxygen treatment solution from and washing the pulp at about 1% pulp consistency to afford final removal of the oxygen treatment solution from the pulp; then (b) a peroxide bleaching stage carried out at 10% to 25% pulp consistency, at 40° to 80° C. and at a pH of 3 to 5 for a reaction time of 10 to 300 minutes, with a peroxide treatment solution comprising 0.2% to about 2% acid hydrogen peroxide, based on oven-dried pulp, followed in sequence by separating the peroxide treatment solution from and washing the pulp at about 1% pulp consistency to afford final removal of the peroxide treatment solution from the pulp; and then (c) at least one ozone bleaching stage carried out at 1% to 40% pulp consistency, at 15° to 60° C. and at a pH of 2 to 7, with an ozone treatment solution until 0.2% to 1% ozone on an oven-dried pulp basis is consumed, each said ozone bleaching stage being followed by separating the ozone treatment solution from and washing the pulp at about 1% pulp consistency to afford final removal of the ozone treatment solution from the pulp.

5. A non-chlorine multi-stage process for bleaching chemical lignocellulosic pulp which minimizes changes in temperature and pH from stage to stage, said process comprising in sequence:

(a) an oxygen bleaching stage carried out at about 3% to 30% pulp consistency, at 80° to 120° C. and at a pH of 9 to 12 for a reaction time of 10 to 60 minutes with an oxygen treatment solution comprising 0.2% to about 3% oxygen, based on oven-dried pulp, followed in sequence by separating the oxygen treatment solution from and washing the pulp at about 1% pulp consistency to afford final removal of the oxygen treatment solution from the pulp; then (b) a peroxide bleaching stage carried out at 10% to 25% pulp consistency, at 40° to 80° C. and at a pH of 3 to 5 for a reaction time of 10 to 300 minutes, with a peroxide treatment solution comprising 0.2% to about 2% acid hydrogen peroxide, based on oven-dried pulp, followed in sequence by separating the peroxide treatment solution from and washing the pulp at about 1% pulp consistency to afford final removal of the peroxide treatment solution from the pulp; and then (c) at least one ozone bleaching stage carried out at 1% to 40% pulp consistency, at 15° to 60° C. and at a pH of 2 to 7, with an ozone treatment solution until 0.2% to 1% ozone on an oven-dried pulp basis is consumed, each said ozone bleaching stage being followed by separating the ozone treatment solution from and washing the pulp at about 1% pulp consistency to afford final removal of the ozone treatment solution from the pulp; each intermediate of said ozone stages being followed, subsequent to said washing, by a caustic extraction stage carried out with a caustic extraction solution followed in sequence by separating the caustic extraction solution from and washing the pulp at about 1% pulp consistency to afford final removal of the caustic extraction solution.

6. A non-chlorine multi-stage process for bleaching chemical lignocellulosic pulp which minimizes changes in temperature and pH from stage to stage, said process comprising in sequence:

(a) an oxygen bleaching stage carried out at about 3% to 30% pulp consistency, at 80° to 120° C. and at a pH of 9 to 12 for a reaction time of 10 to 60 minutes with an oxygen treatment solution comprising 0.2% to about 3% oxygen, based on oven-dried pulp, followed in sequence by separating the oxygen treatment solution from and washing the pulp at about 1% pulp consistency to afford final removal of the oxygen treatment solution from the pulp; then (b) a peroxide bleaching stage carried out at 10% to 25% pulp consistency, at 40° to 80° C. and at a pH of 3 to 5 for a reaction time of 10 to 300 minutes, with a peroxide treatment solution comprising 0.2% to about 2% acid hydrogen peroxide, based on oven-dried pulp, followed in sequence by separating the peroxide treatment solution from and washing the pulp at about 1% pulp consistency to afford final removal of the peroxide treatment solution from the pulp; and then (c) at least one ozone bleaching stage carried out at 1% to 40% pulp consistency, at 15° to 60° C. and at a pH of 2 to 7, with an ozone treatment solution until 0.2% to 1% ozone on an oven-dried pulp basis is consumed, each said ozone bleaching stage being followed by separating the ozone treatment solution from and washing the pulp at about 1% pulp consistency to afford final removal of the ozone treatment solution from the pulp; each intermediate of said ozone stages being followed, subsequent to said washing, by a caustic extraction stage carried out with a caustic extraction solution followed in sequence by separating the caustic extraction solution from and washing the pulp at about 1% pulp consistency to afford final removal of the caustic extraction solution;

the wash for said washing of the pulp following each of said stages is selected from the group consisting of the effluent from the next later stage, the effluent from the washing of said pulp following said next later stage, make-up water, effluent from a recovery process and any combination of same.

* * * * *